US011882966B2

(12) United States Patent
Sechrest, Jr.

(10) Patent No.: US 11,882,966 B2
(45) Date of Patent: Jan. 30, 2024

(54) UPRIGHT MASSAGE TUB THAT CONVERTS INTO A STANDARD BATHTUB

(71) Applicant: Robert J. Sechrest, Jr., Archdale, NC (US)

(72) Inventor: Robert J. Sechrest, Jr., Archdale, NC (US)

( * ) Notice: Subject to any disclaimer, the term of this patent is extended or adjusted under 35 U.S.C. 154(b) by 119 days.

(21) Appl. No.: 17/713,708

(22) Filed: Apr. 5, 2022

(65) Prior Publication Data

US 2022/0225842 A1 Jul. 21, 2022

Related U.S. Application Data

(63) Continuation-in-part of application No. 17/139,977, filed on Dec. 31, 2020, now Pat. No. 11,331,243.

(60) Provisional application No. 62/955,602, filed on Dec. 31, 2019.

(51) Int. Cl.

| | |
|---|---|
| ***A47K 3/07*** | (2006.01) |
| ***A47K 3/00*** | (2006.01) |
| ***A47K 3/12*** | (2006.01) |

(52) U.S. Cl.

CPC ..... *A47K 3/07* (2013.01); *A47K 3/006* (2013.01); *A47K 3/122* (2013.01)

(58) Field of Classification Search

CPC ..... A47K 3/12; A47K 3/122; A47K 3/006; A47K 3/007

USPC ..... 4/541.3

See application file for complete search history.

(56) References Cited

U.S. PATENT DOCUMENTS

| | | | | |
|---|---|---|---|---|
| 3,936,891 | A | 2/1976 | Kulde | |
| 4,446,586 | A | 5/1984 | Reed et al. | |
| 4,592,099 | A | 6/1986 | Zellner | |
| 4,596,241 | A | 6/1986 | Neudorfer | |
| 5,077,841 | A | 1/1992 | Sugai | |
| 6,572,570 | B1 | 6/2003 | Burns et al. | |
| 6,708,961 | B2 | 3/2004 | Ferber et al. | |
| 7,472,432 | B2 | 1/2009 | Owen | |
| 8,561,223 | B2 | 10/2013 | Sato et al. | |
| 10,506,899 | B2 | 12/2019 | Szutkowski | |
| 2006/0265803 | A1 | 11/2006 | Brunelle et al. | |
| 2008/0178380 | A1* | 7/2008 | Rydalch | A47K 3/006 4/555 |
| 2008/0276363 | A1 | 11/2008 | Chen | |
| 2011/0056013 | A1* | 3/2011 | Seymour | A47K 3/006 4/560.1 |
| 2013/0000033 | A1 | 1/2013 | Gilleran | |
| 2013/0263371 | A1* | 10/2013 | Qian | A47K 3/02 4/584 |
| 2014/0338115 | A1 | 11/2014 | Sadler | |
| 2015/0107017 | A1* | 4/2015 | Haddad | A47K 3/006 4/556 |
| 2016/0271012 | A1* | 9/2016 | Xu | A61H 33/6021 |
| 2018/0192829 | A1* | 7/2018 | Manchiraju | A47K 3/003 |
| 2022/0062092 | A1 | 3/2022 | Sechrest | |

* cited by examiner

*Primary Examiner* — Huyen D Le

(74) *Attorney, Agent, or Firm* — James G. Passé; Passé Intellectual Property, LLC

(57) ABSTRACT

A walk-in tub design that can also act as a standard bathtub via a hub that can be moved out of the way, and is capable of converting from a standard walk-in shower to a standard bathtub in the lowered position.

4 Claims, 8 Drawing Sheets

UPRIGHT MASSAGE TUB THAT CONVERTS INTO A STANDARD BATHTUB

This application claims priority to a U.S. non-provisional application Ser. No. 17/139,977 filed on Dec. 31, 2020, which claims priority to U.S. provisional application No. 62/955,602 filed on Dec. 31, 2019. This application is also a 371 of PCT application US21/65618 filed on Dec. 30, 2021 and all are incorporated herein in their entirety by reference.

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

Field of the Invention

The present invention relates to a tub design that allows for both built-in seating and conversion to a standard tub design.

Description of Related Art

Traditional bathtubs and traditional water-jet style massage tubs do not offer adequate ergonomic design for users entering/exiting the tub, or for user assistants in helping users enter/exit the tub. Also, these traditional designs do not offer users a full body therapeutic massage experience for a user's frontal upper body, frontal thighs, and stomach. The newer walk-in style tubs do make entering and exiting the tub easier, but they do not offer users a full body therapeutic massage experience, and they are not designed for bathing children or pets. Until recently, a choice would always have to be made to choose one or the other. Otherwise, two tubs would be needed to benefit from both a therapeutic massage experience and a walk-in style tub with seating.

BRIEF SUMMARY OF THE INVENTION

The present invention relates to a tub design that overcomes the above problems and more, as will be seen. It is a walk-in tub/shower that is convertible into a bathtub. Accordingly, in one embodiment, there is an upright walk-in tub having a leg compartment and a built-in seat comprising a hub positioned to seal against the leg compartment to create a standard bathtub, wherein the hub can be moved out of the way to use the leg compartment, wherein the hub is moved out of the way by the method consisting of:

a) being raised on a vertical rail; and b) being moved via a hinge attachment.

DISCLOSURE OF INVENTION

The present invention is a step/sit design of a massage tub with the seat height approximating a standard chair seat height. This step/sit design allows for available space above the user for a heated water tank and a multi-functional adjustable hub. The heated water tank will provide the tub with a quick-fill feature that is capable of delivering the stored water to the tub in a rapid release of water volume, filling the tub for use without delay. The adjustable hub innovation provides users with frontal massage capability, as well as the ability to convert the upright massage tub into a standard bathtub for bathing children and/or pets.

The adjustable hub operates on a vertical rail that is located on the back wall of the tub, and which has four adjustable Positions. Position 1 is where the hub is at the top of the rail, out of the way of a user entering or exiting the tub. Position 2 is where the hub is lowered from Position 1 into a position where its housed water jet can deliver a proximity source of water-jet flow for massaging a user's frontal upper body. Position 3 is where the hub is lowered from Position 2 into a position where its housed waterjet can deliver a proximity source of water-jet flow for a therapeutic massage of a user's frontal thighs and stomach. Position 4 is where the hub is lowered into its lowest position, where the right side of the hub meets the front edge of the seat, sealing off the leg compartment of the tub. The hub top can then be unfolded to cover the seat, thereby converting the tub into a traditional shaped bathtub for bathing children and pets—but at a superior ergonomic height.

BRIEF DESCRIPTION OF DRAWINGS

Additional characteristics of the advantages of the disclosed invention are further revealed by accompanying drawings wherein.

DRAWINGS REFERENCE NUMERALS

Figure 1:
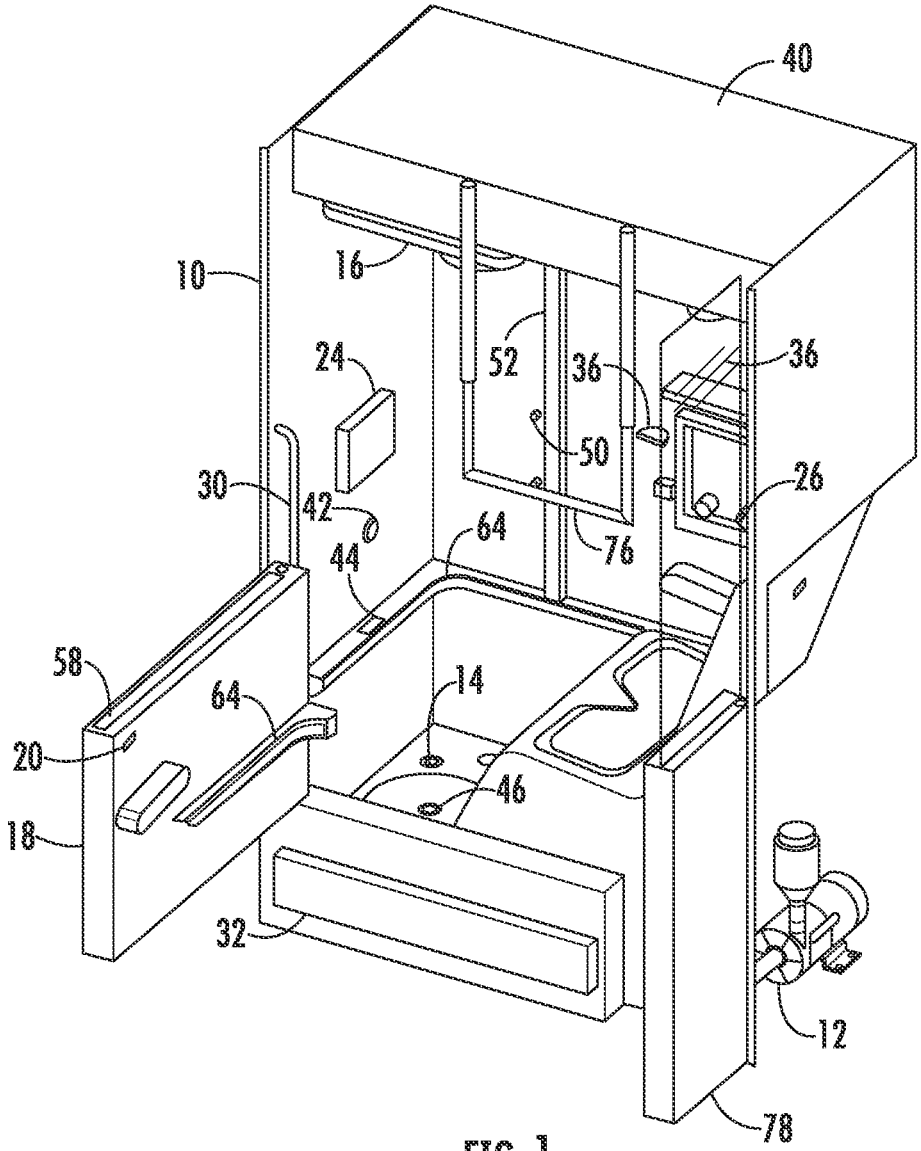
FIG. 1: Is a perspective view of the present invention.

10: Tub.
12: Heated air jet motor.
14: Water-jets.
16: Height adjustable hub/plug.
18: Watertight door.
20: Lock.
22: Adjustment dials.
24: Control panel.
26: Water valve knobs.
28: Faucet.
30: Safety handle.
32: Step.
34: Glass panel.
36: Hand-held shower head.
38: Stationary shower head.
40: Heated water tank.
42: Lower drain control.
44: Upper-level drain with plug.

46: Lower-level drain.
48: Seat drain holes.
50: Air jet water ports.
52: Vertical rail.
54: Adjustable hub top that unfolds to become leveling seat cover.
56: Anti-slip surface.
58: Safety screen.
60: Shelf.
62: Sealing lip.
64: Sealing ledge.
66: Door hinge rod.
68: Lower level quick-fill faucet.
70: User.
72: Canine.
74: Upper tub frame structure.
76: Telescoping handle.
90: Out of the way hub.
91: Hinge for out of the way hub.

While this invention is susceptible to embodiment in many different forms, there is shown in the drawings, and will herein be described in detail, specific embodiments with the understanding that the present disclosure of such embodiments is to be considered as an example of the principles and not intended to limit the invention to the specific embodiments shown and described. In the description below, like reference numerals are used to describe the same, similar, or corresponding parts in the several views of the drawings. This detailed description defines the meaning of the terms used herein and specifically describes embodiments in order for those skilled in the art to practice the invention.

Definitions

The terms "about" and "essentially" mean±10 percent.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

The term "comprising" is not intended to limit inventions to only claiming the present invention with such comprising language. Any invention using the term comprising could be separated into one or more claims using "consisting" or "consisting of" claim language and is so intended.

Reference throughout this document to "one embodiment", "certain embodiments", "an embodiment", or similar terms means that a particular feature, structure, or characteristic described in connection with the embodiment is included in at least one embodiment of the present invention. Thus, the appearances of such phrases in various places throughout this specification are not necessarily all referring to the same embodiment. Furthermore, the particular features, structures, or characteristics may be combined in any suitable manner in one or more embodiments without limitation.

The term "or", as used herein, is to be interpreted as an inclusive or meaning any one or any combination. Therefore, "A, B, or C" means any of the following: "A; B; C; A and B; A and C; B and C; A, B, and C". An exception to this definition will occur only when a combination of elements, functions, steps, or acts are in some way inherently mutually exclusive.

The drawings featured in the figures are for the purpose of illustrating certain convenient embodiments of the present invention and are not to be considered as limitation thereto. The term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein, and use of the term "means" is not intended to be limiting.

As used herein, the term "upright tub" refers to a tall walk-in tub design wherein there is a water tight door(s) to allow easy entry to the built-in seat. See FIG. 1.

As used herein, the term "leg compartment" refers to the space in front of the built-in seat designed as an area to place the feet when seated on the built-in seat.

As used herein, the term "built-in seat" refers to a seat that is built-in or a part of the tub itself as seen in a standard walk-in tub. It takes up about half or less of the floor space in the walk-in tub, the rest of the floor space being the leg compartment.

As used herein, the term "hub" refers to a device which seals off the leg compartment in a water tight manner to create a bathtub consisting of the hub and built-in seat forming the bottom of the bathtub. In two embodiments, the hub can either be folded out of the way, removed out of the way, or raised out of the way to use the tub as a walk-in tub. Other means for moving the hub out of the way are within the scope of the definition.

As used herein, the term "raised/lowers" refers to being able to have the hub seal against the leg compartment lowered to form a standard tub or raised to allow for sitting on the built-in seat.

As used herein, the term "out of the way" refers to the hub being moved to a position, wherein the hub is no longer sealing off the leg compartment.

As used herein, the term "seal" refers to the hub forming a water tight seal against the seat sufficient to form a continuous tub surface bottom sufficient to keep water from leaking into the leg compartment.

As used herein, the term "vertical rail" refers to a rail as shown in the Figures for raising the hub away from the leg compartment.

Figure 9:
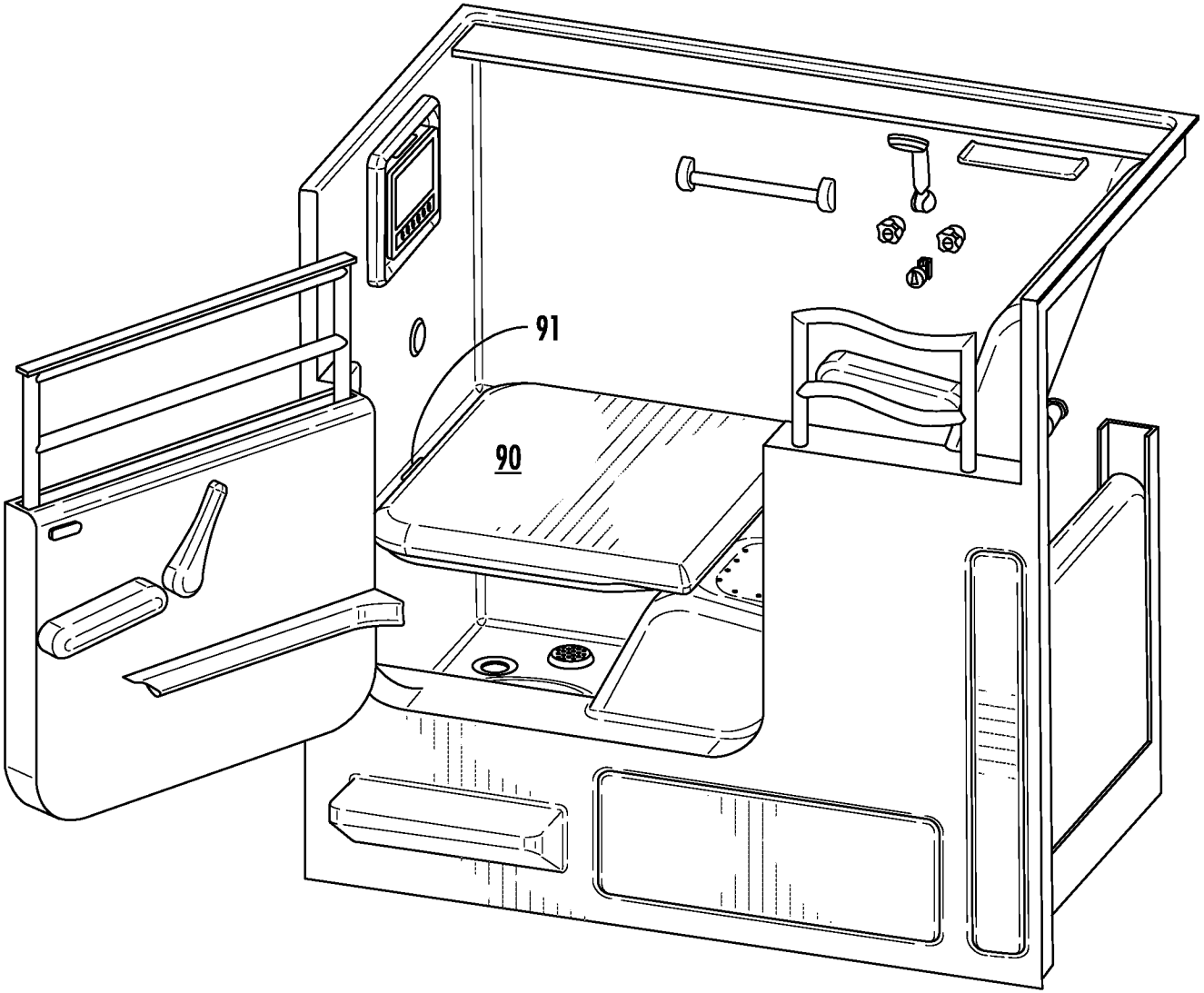
FIG. 9: Illustrates an embodiment of the present invention, wherein the out of the way hub is shown in the closed position to be used as a built-in seat.

As used herein, the term "hinge" refers to an embodiment wherein the hub is connected to a wall of the tub (as shown in FIG. 9) and raised and lowered via a hinge connection to the wall.

As used herein, the term "water-jet" refers to standard water-jets found in walk-in tubs and massage tubs.

As used herein, the term "standard tub" refers to a tub designed for filling with water and soaking.

DRAWINGS

Figure 2:
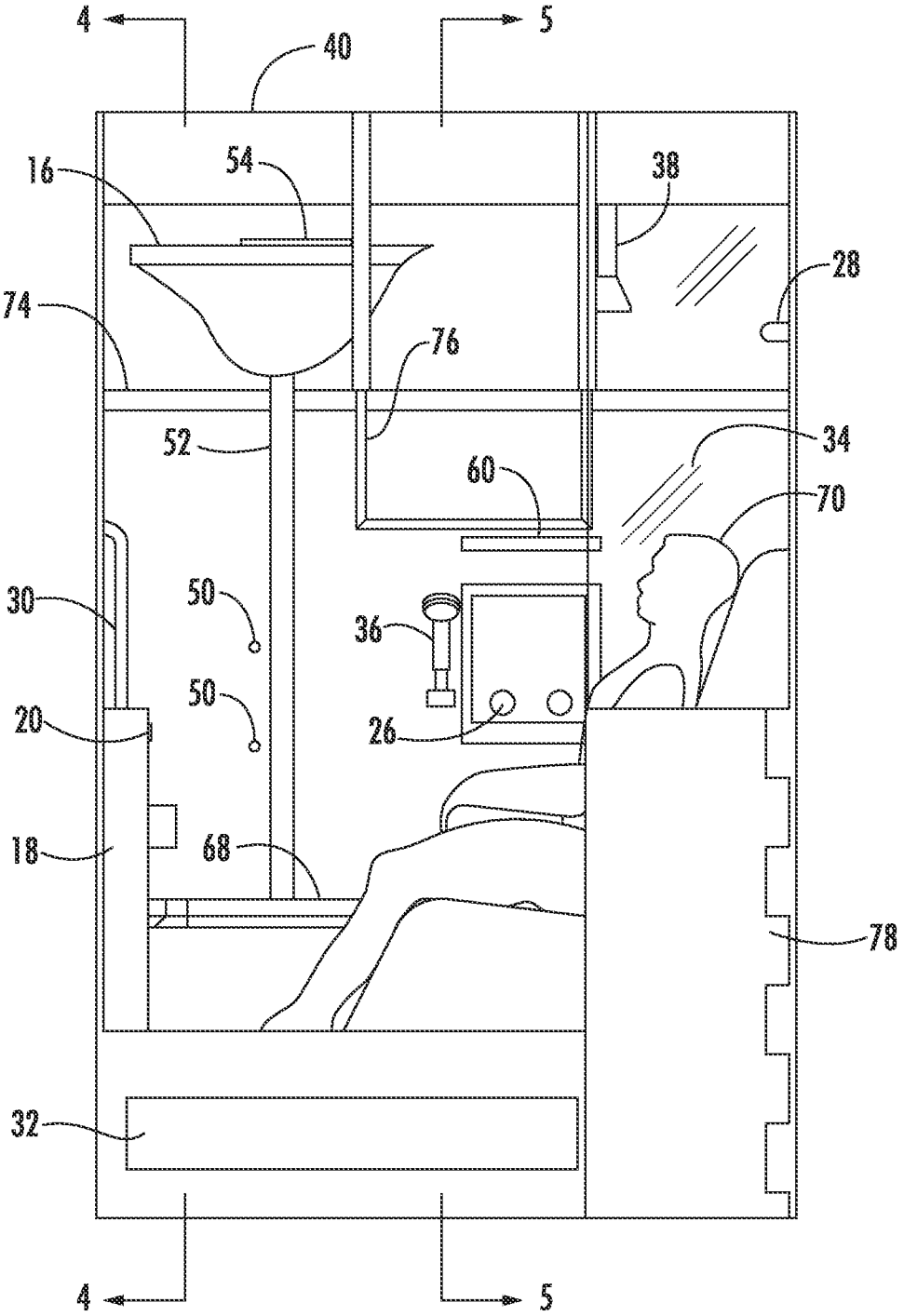
FIG. 2: Is a front view of the present invention shown in-use with the door open.

FIG. 1 illustrates a perspective view of the preferred embodiment of the present invention. The hydro-massaging/bathing apparatus consists of a tub 10, made of fiberglass, having a height of no more than eight feet, with the top one foot of the apparatus consisting of a heated water tank 40. Opening to the left and the right side of the tub apparatus is a watertight door 18 that has a lock 20 on the upper interior of the left door that locks the door, as well as the frame of the tub apparatus. On the inside of the watertight door 18 there is a tub sealing ledge 64 that connects with the tub in two places when the watertight door 18 is closed. The left side of the watertight door's sealing ledge 64 connects with the sealing ledge 64 located opposite of the seat, while the right side of the tub door's sealing ledge 64 connects with the tub seat. This allows for the sealing-off of the lower compartment (leg area) of the tub by the height adjustable hub/plug 16 shown in FIG. 2, as part of the process of converting the upright tub into a standard shaped bathtub for bathing children and/or pets. Located on the tub sealing ledge 64 opposite of the seat, there is the upper-level tub drain 44, to be opened and closed manually with a plug. Also located on the opposite wall of the seat, above the upper-level tub drain 44, there is a lower-drain control 42 that controls the opening and closing of the lower drain 46 located at the bottom and in the middle of the lower tub. On each side of lower drain 46, there is a water jet 14, for massaging the user's feet and legs. Water jets 14 are for delivering a massage to the user. FIG. 2 illustrates an embodiment of the tub's frontal aspect. The height adjustable hub/plug 16 is attached to the vertical rail 52 located on the back wall. As part of the process for converting the upright massage tub into a standard shaped bathtub for bathing children and/or pets, when the height adjustable hub/plug 16 is in its lowest position down the vertical rail 52, the hub top is the adjustable hub top that unfolds to become leveling seat cover 54. At the bottom of the tub on the back wall, there is a lower level quick-fill faucet 68 that allows for a rapid water release from the heated water tank 40 to the lower tub. On the wall opposite the seat, is safety handle 30 which allows for safe user entry and exit of the tub. On the right tub door, resting on the apparatus tub frame and extending vertically to the heated water tank 40 is the shower-glass panel 34 which keeps water from splashing out of the tub. The user 70 is sitting on the seat behind this glass panel. Above the user 70 is the upper tub frame structure 74 that frames-out the front facing section of the heated water tank 40 and the height adjustable hub/plug 16. The upper tub frame structure 74 has an upper and lower horizontal support rail, as well as two vertical support rails that divide the upper tub frame structure 74 into three evenly spaced rectangle sections that will be filled with panes of shower glass. These two vertical support rails are designed in such way that they will house the telescoping handle 76 that can be easily lowered and raised as needed, into a position that helps the user safely enter and exit the tub.

Figure 3:
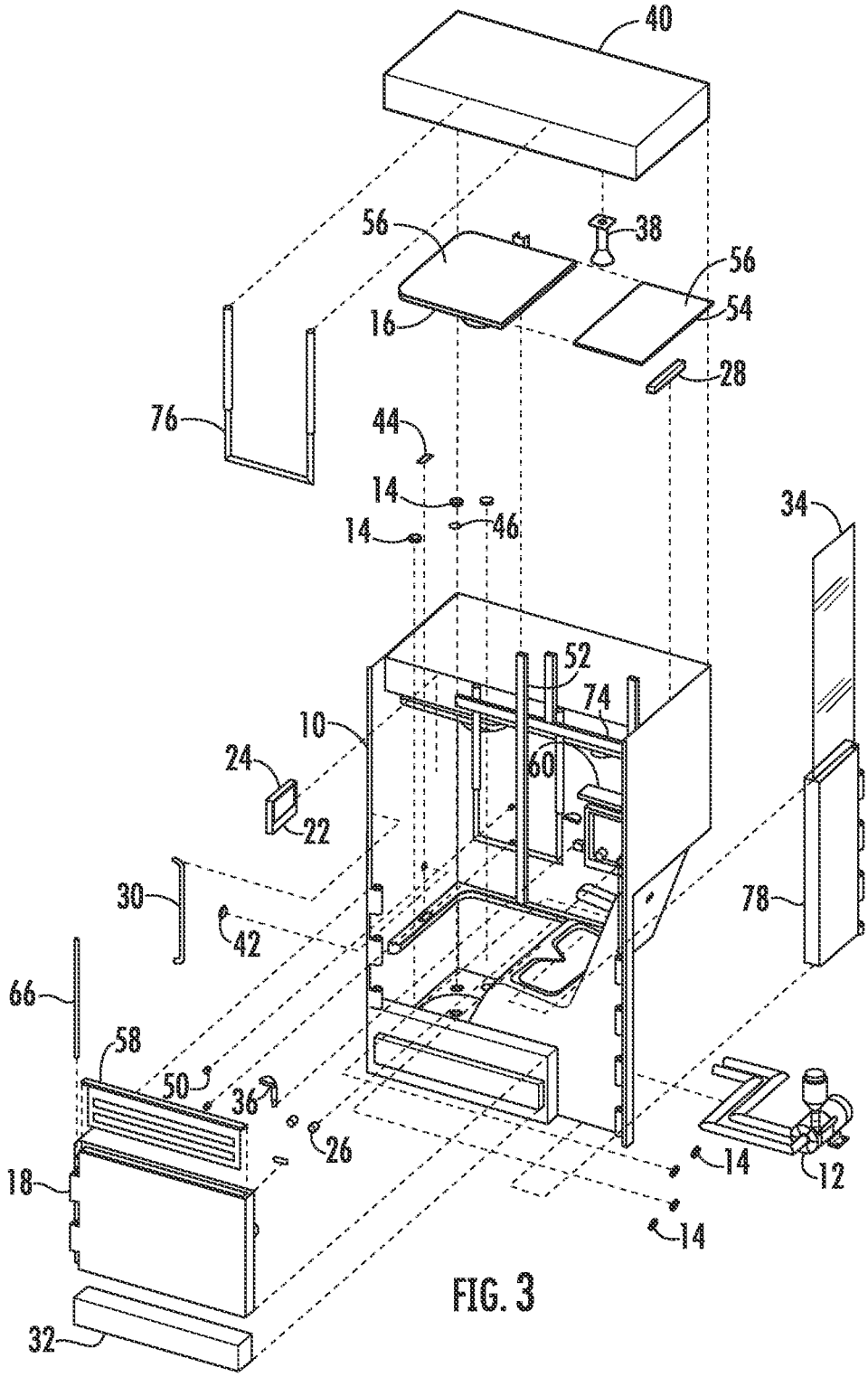
FIG. 3: Is an exploded view of the present invention.

FIG. 3 illustrates an exploded view of the present invention. When the upright massage tub is converted to a standard shaped bathtub for bathing children and/or pets, the adjustable hub top that unfolds to become leveling seat cover 54 will have the anti-slip surface 56, to help children and pets with their footing. The heated air jet motor 12 (housed under the tub seat) pressurizes water and air, pumping water and air through the tub's strategically placed water jets 14. The door hinge rod 66 allows the door to hinge between an open or closed position. Below the door, the step 32 allows users to enter and exit the tub safely and efficiently.

Figure 4:
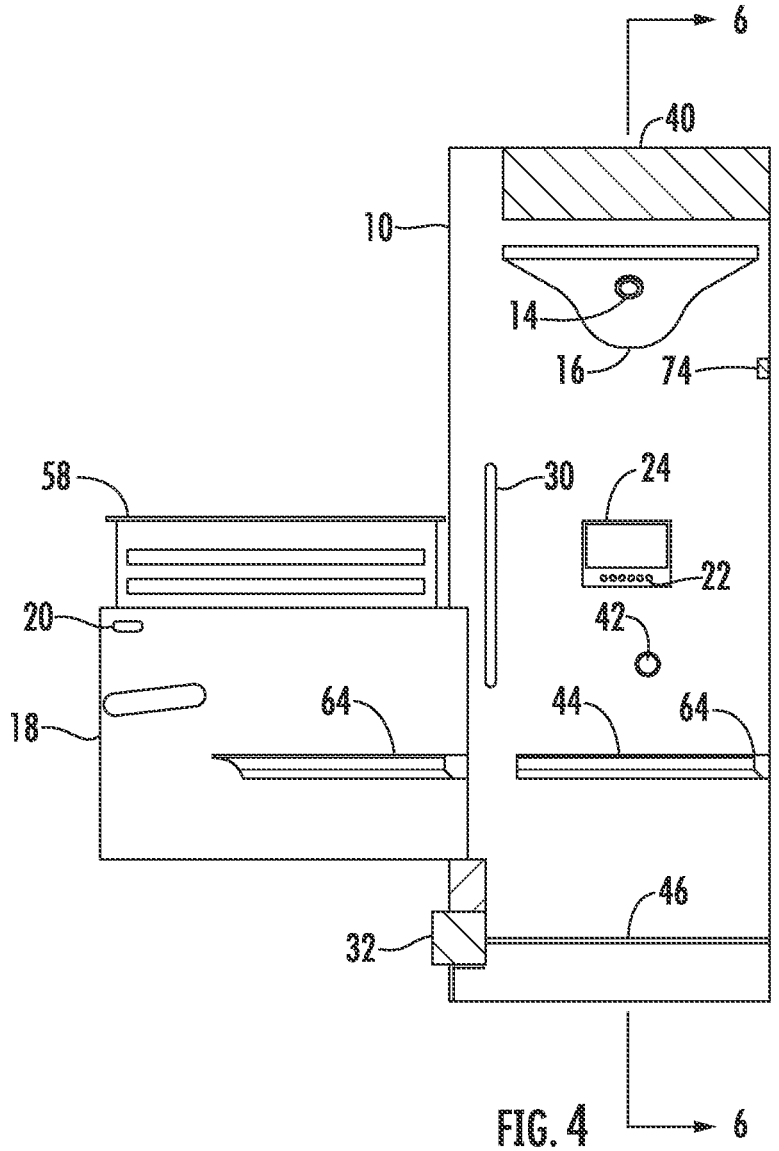
FIG. 4: Is a section view of the present invention taken along line 4-4 from FIG. 2.

FIG. 4 illustrates a left side view of the tub, from a perspective opposite the seat. The safety screen 58, shown in the "up" position coming from within and rising above the top of the open door, protects children and/or pets from falling out of the tub. At a height above the top of the tub, and above the top of the water's height potential, is the control panel 24 for user display and/or functioning apparatus controls. Under the control panel 24 are the adjustment dials 22 which are used to select optimal pressurized water and air flow to desired water jet(s) 14 destinations.

Figure 5:
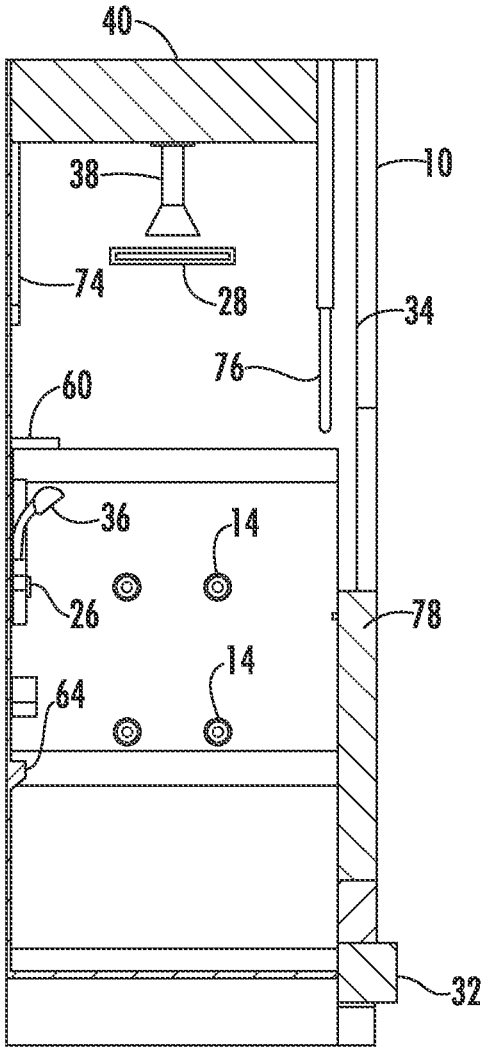
FIG. 5: Is a section view of the present invention taken along line 5-5 from FIG. 2.

FIG. 5 illustrates a view of the invention tub seat from the opposite left side tub wall. The faucet 28 allows the tub to be filled via regular hot and cold water lines/controls.

Figure 6:
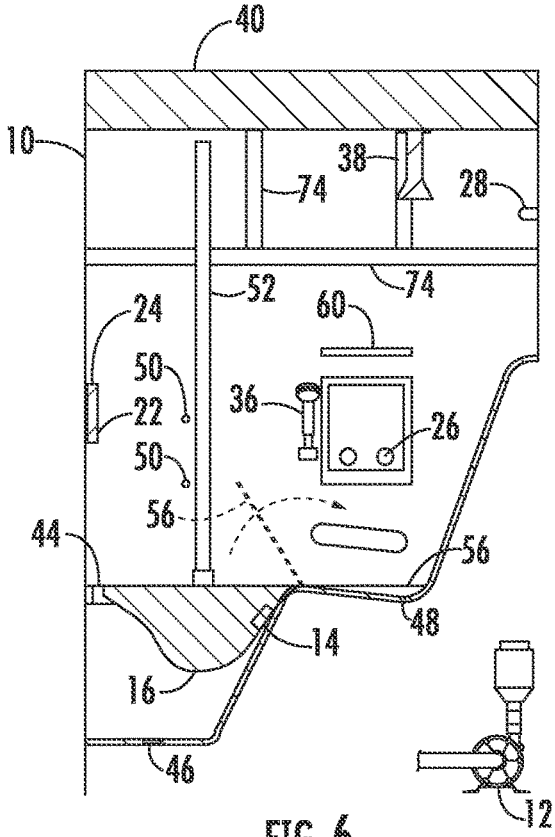
FIG. 6: Is a section view of the present invention taken along line 6-6 from FIG. 4.

FIG. 6 illustrates a variation of the tub's frontal aspect. On the back wall is the shelf 60 for the placement of useful items. Below the shelf, are the water valve knobs 26 for controlling hot and cold water flow to the faucet 28 (shown in FIG. 5). Above the water valve knobs 26 is the hand-held shower head 36 for rinsing, as needed. Left proxy to the vertical rail 52 (shown in FIG. 2) are the air jet water ports 50 that direct pressurized water and air flow to the height adjustable hub/plug 16 (shown in FIG. 2). At gravity's low point of the seat, are the seat drain holes 48 that drain water from the seat to the lower compartment (leg area) of the tub.

Figure 7:
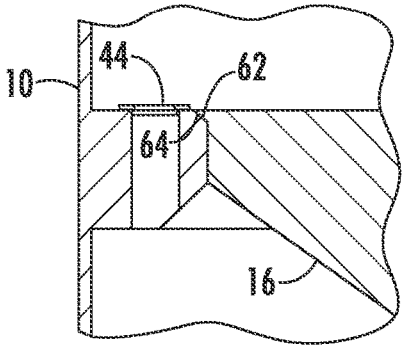
FIG. 7: Is an enlarged detail view of the seal of the present invention.

FIG. 7 illustrates the sealing lip 62 of the height adjustable hub/plug 16 while the height adjustable hub/plug 16 is lowered into its lowest vertical position for converting the tub from an upright massage tub into a standard shaped bathtub for bathing children and/or pets. Hereinto, the sealing lip 62 of the height adjustable hub/plug 16 seals with the tub's sealing ledge 64 (shown in FIG. 1), creating a water-seal between the upper and lower sections of the tub.

Figure 8:
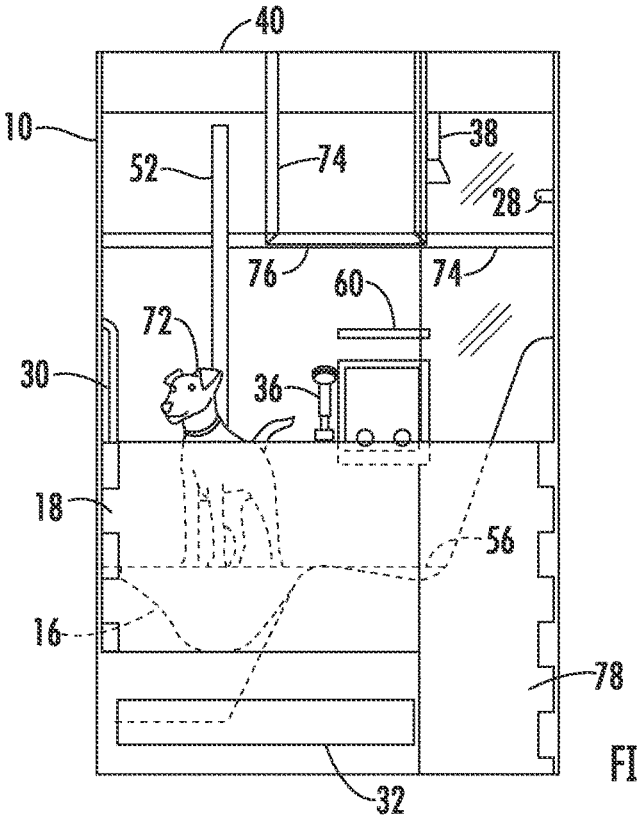
FIG. 8: Is a front view of the present invention shown in use.

FIG. 8 illustrates the tub as it would be used for bathing children and/or pets. A stationary shower head 38 directs water for user showering and/or user head and upper-body massage. The canine 72 provides visual reference as to the superior ergonomic position this upright massage tub that converts into a standard bathtub invention provides people for bathing children and/or pets.

FIG. 9 is a perspective view where the out of the way hub 90 can seal against the built-in seat and fold out of the way when not needed, using hinge 91.

Figure 10:
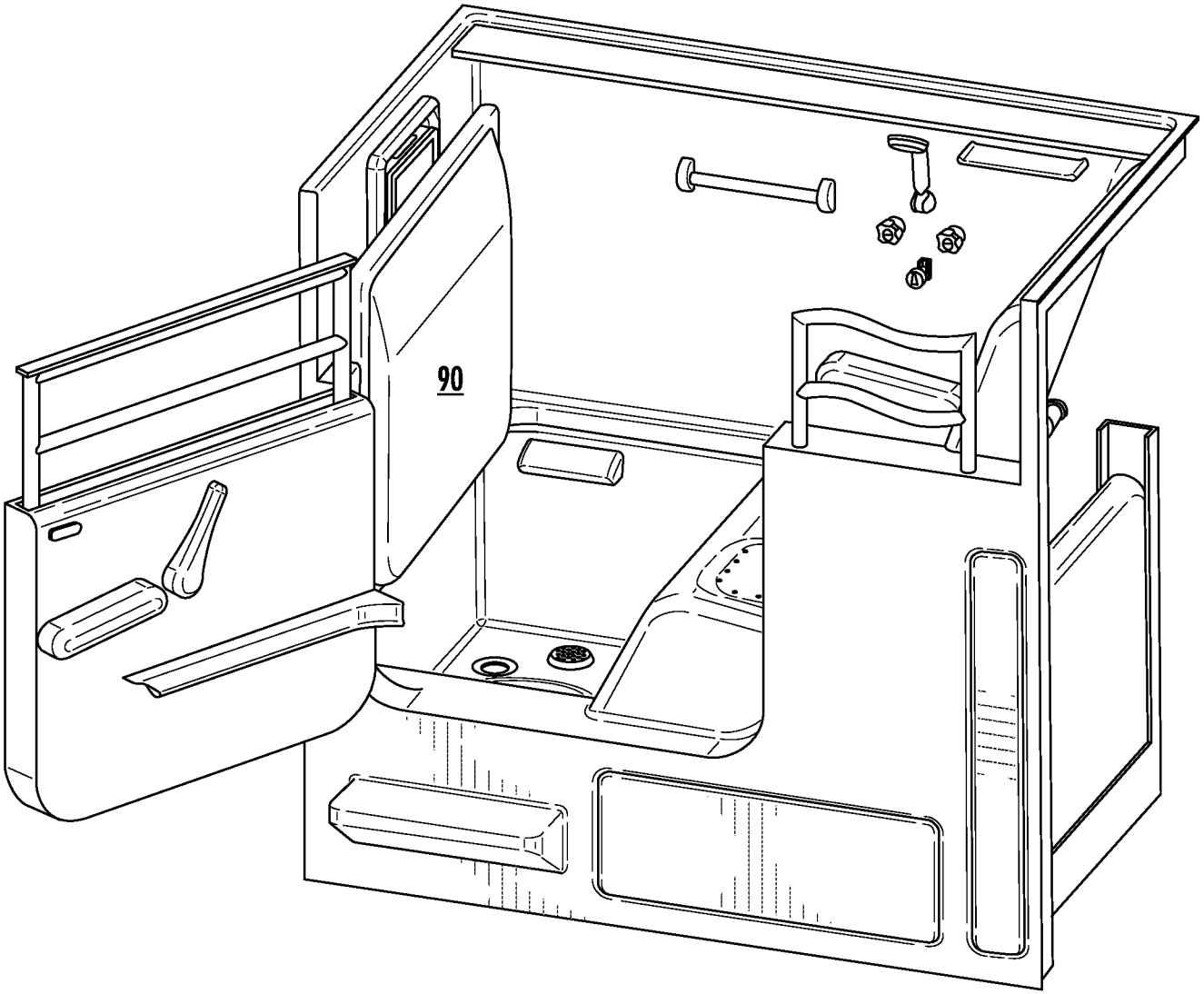
FIG. 10: Illustrates an embodiment of the present invention wherein the out of the way hub is lifted out of the way via a hinge.

FIG. 10 is a perspective view of the out of the way hub with hub 90 in an open and out of the way position.

Those skilled in the art to which the present invention pertains may make modifications resulting in other embodiments employing principles of the present invention without departing from its spirit or characteristics, particularly upon considering the foregoing teachings. Accordingly, the described embodiments are to be considered in all respects only as illustrative, and not restrictive, and the scope of the present invention is, therefore, indicated by the appended claims rather than by the foregoing description or drawings. Consequently, while the present invention has been described with reference to particular embodiments, modifications of structure, sequence, materials, and the like apparent to those skilled in the art still fall within the scope of the invention as claimed by the applicant.

What is claimed is:

1. An upright walk-in tub having a leg compartment and a built-in seat comprising a hub positioned to seal against the leg compartment to create a standard bathtub, wherein the hub can be moved out of the way to use the leg compartment, wherein the hub is moved out of the way by the method consisting of:

c) being raised on a vertical rail; and d) being moved via a hinge attachment.

2. The upright walk-in massage tub according to claim 1, wherein the hub can be removed.

3. The upright walk-in massage tub according to claim 1, which further comprises a water jet for delivering massage.

4. The upright walk-in massage tub according to claim 1, which further comprises at least one water tight door.

* * * * *